US009316395B2

(12) United States Patent
Diesselhorst et al.

(10) Patent No.: US 9,316,395 B2
(45) Date of Patent: Apr. 19, 2016

(54) DEVICE FOR DISCHARGING AN EXPLOSIVE GAS

(75) Inventors: Tilman Diesselhorst, München (DE); Miks Hartmann, Erlangen (DE); Dirk Knief, Mülheim an der Ruhr (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 292 days.

(21) Appl. No.: 13/202,122

(22) PCT Filed: Feb. 19, 2010

(86) PCT No.: PCT/EP2010/052155

§ 371 (c)(1), (2), (4) Date: Oct. 18, 2011

(87) PCT Pub. No.: WO2010/097348

PCT Pub. Date: Sep. 2, 2010

(65) Prior Publication Data

US 2012/0039018 A1 Feb. 16, 2012

(30) Foreign Application Priority Data

Feb. 24, 2009 (EP) ..... 09002576

(51) Int. Cl.
*F23L 17/16* (2006.01)
*F24F 13/26* (2006.01)
(Continued)

(52) U.S. Cl.
CPC ..... *F23L 17/16* (2013.01); *F24F 13/26* (2013.01); *E04F 17/02* (2013.01); *E04H 12/28* (2013.01); *F23G 7/085* (2013.01)

(58) Field of Classification Search
CPC ..... F23L 17/16; F23L 17/02; F23L 17/04; F23L 17/06; F23L 17/12; F23G 7/08; F23G 7/085; E04H 12/28; E04F 17/02; F24F 13/26
USPC ..... 431/202; 110/184, 127, 121, 160, 159, 110/161, 150; 239/594, 312, 276, 279, 280, 239/280.5, 281; 126/307 R, 312, 307 A
See application file for complete search history.

(56) References Cited

U.S. PATENT DOCUMENTS 517,793 A * 4/1894 Cottier ..... 110/160
2,375,180 A * 5/1945 Vigo ..... 417/151

(Continued)

FOREIGN PATENT DOCUMENTS

CN 1170088 C 10/2004
DE 19517163 A1 11/1996

(Continued)

OTHER PUBLICATIONS

"Nozzle": Webster's Third New International Dictionary, Unabridged. Merriam-Webster, Incorporated: 1993. <http://lionreference.chadwyck.com>. Accessed Nov. 15, 2013.*

(Continued)

*Primary Examiner* — Kenneth Rinehart
*Assistant Examiner* — Tavia Sullens

(57) ABSTRACT

A device for releasing an explosive gas via a stack arranged on a roof of a building is provided. The upper free end of the stack is provided with a discharging head including a plurality of distribution pipes projecting from the stack in the form of a star. Each pipe includes an outlet on the free end thereof. The device reduces the pressure wave load exerted during an explosion even during adverse wind conditions. To this end, the end regions of the distribution pipes are embodied as jet pumps in which the explosive gas is the propellant sucking the ambient air.

1 Claim, 2 Drawing Sheets

(51) Int. Cl.

| | |
|---|---|
| ***E04F 17/02*** | (2006.01) |
| ***E04H 12/28*** | (2006.01) |
| ***F23G 7/08*** | (2006.01) |

(56) References Cited

U.S. PATENT DOCUMENTS

| | | | | | |
|---|---|---|---|---|---|
| 3,545,886 | A | * | 12/1970 | Chalom | 417/196 |
| 4,045,944 | A | | 9/1977 | Giori | |
| 4,073,613 | A | * | 2/1978 | Desty | 431/202 |
| 4,323,343 | A | * | 4/1982 | Reed et al. | 431/202 |
| 4,940,392 | A | * | 7/1990 | Adkins | 417/196 |
| 5,975,885 | A | * | 11/1999 | Rajewski | 431/202 |
| 6,086,333 | A | * | 7/2000 | Krutzfeldt et al. | 417/54 |

FOREIGN PATENT DOCUMENTS

| | | | | | |
|---|---|---|---|---|---|
| DE | 19517163 | C2 | | 7/1997 | |
| EP | 0290390 | A1 | * | 11/1988 | F23L 17/02 |
| FR | 2359380 | A1 | | 2/1978 | |
| GB | 190913720 | A | | 6/1910 | |
| JP | S53116534 | A | | 10/1978 | |
| JP | 5300702 | A | | 11/1993 | |
| JP | 2000018550 | A | | 1/2000 | |
| JP | 2000503199 | A | | 3/2000 | |
| JP | 2005209427 | A | | 8/2005 | |
| JP | 2005226667 | A | | 8/2005 | |
| JP | 2009005438 | A | | 1/2009 | |
| RU | 1807297 | | | 4/1993 | |

OTHER PUBLICATIONS

SU 1807297 A1: English Translation. Translated by FLS, Inc. for United State Patent and Trademark Office, Nov. 2014.*

Partial English Machine Translation EP 0290390: Accessed Oct. 2, 2015.*

* cited by examiner

DEVICE FOR DISCHARGING AN EXPLOSIVE GAS

CROSS REFERENCE TO RELATED APPLICATIONS

This application is the US National Stage of International Application No. PCT/EP2010/052155, filed Feb. 19, 2010 and claims the benefit thereof. The International Application claims the benefits of European Patent Office application No. 09002576.8 EP filed Feb. 24, 2009. All of the applications are incorporated by reference herein in their entirety.

FIELD OF INVENTION

The present invention relates to a device for discharging an explosive gas via a stack that is arranged on a roof of a building and on whose upper free end there is provided a discharging head that consists of a plurality of distributor pipes emanating in a star shape fashion from the stack and which are respectively provided at their free end with an exit opening.

BACKGROUND OF INVENTION

Large generators in power plants are cooled with hydrogen as a rule. In the event of malfunctions, this hydrogen must be removed from the generators as rapidly as possible. This rapid emptying is performed by discharging the hydrogen into the atmosphere via the roof of the power house. Since hydrogen is an explosive gas, there is the risk of a detonating gas explosion upon exit into the atmosphere and upon mixing with the atmospheric oxygen. The pressure wave propagating from the ignition location above the discharging device can cause damage to the roof of the power house in which the generators are located.

Devices of the type mentioned at the beginning are provided in order largely to reduce this pressure wave loading. Such a device for discharging an explosive gas is described in DE 195 17 163 A1, for example.

In this known arrangement, the exiting gas is separated into a number of gas jets corresponding to the number of the exit openings; said gas jets are separated from one another spatially, at least in the ignitable volume regions thereof. The gas jets can therefore not ignite together, and so the pressure wave occurring from an explosion is of smaller amplitude.

However, this does not hold in the case of strong wind conditions. Given strong wind conditions, the ignitable volume regions separated spatially from one another can be blown together again to form a single large ignitable volume region.

SUMMARY OF INVENTION

It is an object of the present invention to specify a device of the type mentioned at the beginning in the case of which the pressure wave loading exerted in the event of an explosion is reduced even given adverse weather conditions.

This object is achieved according to the invention in the case of the device mentioned at the beginning by virtue of the fact that the end regions of the distributor pipes are designed as jet pumps in which the explosive gas is the motive medium that takes in the ambient air.

In the inventive device, the mean density in the discharged jet is increased, thus giving rise to a larger jet impulse. The increase in the mean density is a consequence of the fact that air is approximately ten times as dense as hydrogen. In this way, the ignitable volumes are reduced and as a consequence of the large jet impulse no large deflection occurs when the wind is strong.

BRIEF DESCRIPTION OF THE DRAWINGS

Further expedient refinements of the present invention emerge from the subclaims and from the following description of an exemplary embodiment with the aid of the attached drawing, in which:

DETAILED DESCRIPTION OF INVENTION

Figure 1:
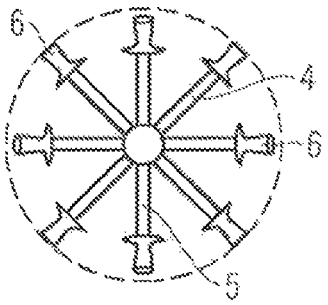
FIG. 1 shows a schematic side view of an inventive device for discharging an explosive gas.
Figure 2:
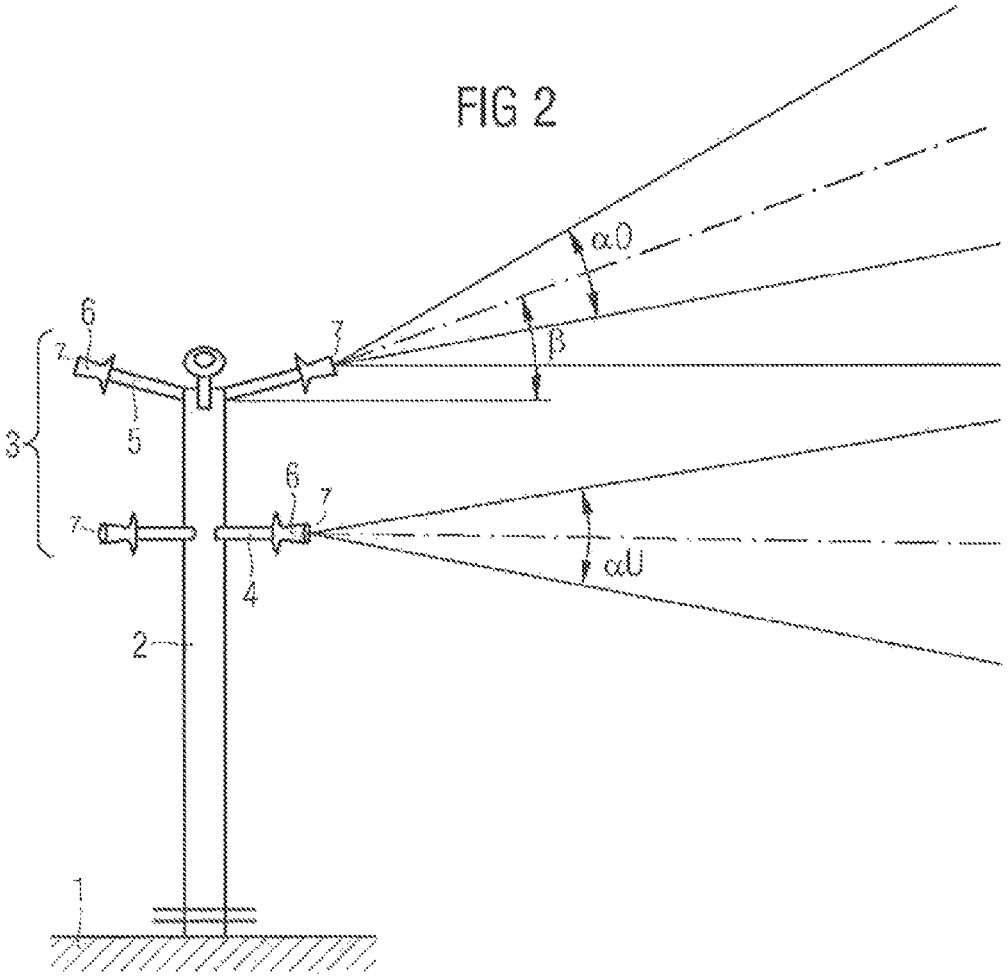
FIG. 2 shows a plan view of the device illustrated in FIG. 1.

FIG. 1 shows a side view of an inventive device for discharging an explosive gas that substantially comprises a stack 2 and a discharging head 3, the stack being mounted on a roof 1.

In the inventive device, the discharging head 3 is designed such that the distributor pipes are split into two levels. The distributor pipes 4 are located in the lower level, and the distributor pipes 5 are located in the upper level. As shown in the figures, exit openings 7 of the pipes 4 are in the lower level and exit openings 7 of the pipes 5 are in the upper level.

In order to achieve a yet greater separation of the explosive mixed gas jets blown out, the distributor pipes of the upper level are inclined upward at a prescribed angle, while the distributor pipes 4 and 5 are arranged in an alternating fashion.

In accordance with the invention, a jet pump 6 is respectively located at the end of the distributor pipes.

Figure 3:
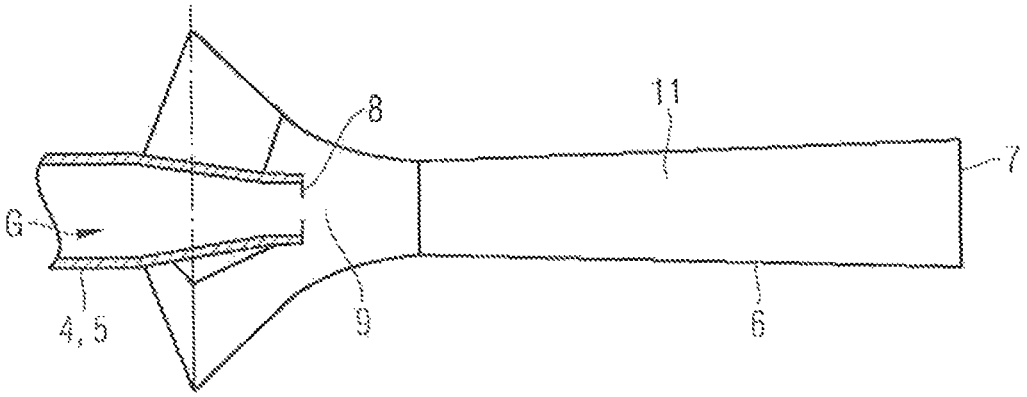
FIG. 3 shows a longitudinal section through a jet pump of the inventive device.

The design of the jet pump 6 is illustrated schematically in FIG. 3.

The respective distributor pipe, via which the hydrogen gas G is fed is illustrated at 4, 5. The driving nozzle 8 is located on the end of the respective distributor pipe. In the mixing chamber 9 situated therebefore, the air is sucked in owing to the underpressure set up in the diffuser neck. The gas is mixed substantially in the diffuser 11 with the intake air as far as the exit opening 7, through which it is blown out.

$\alpha o$ and $\alpha u$ respectively mark the emission angles of the air/gas mixture. $\beta$ marks the angle of inclination of the upper distributor pipes 5. It is clearly to be seen from FIG. 1 that the inclination of the upper distributor pipes 5 upward by a prescribed angle yet further separates from one another the ignitable volumes that are located within the emission angles.

We claim:

1. A device for discharging an explosive gas, comprising:

a stack that is arranged on a roof of a building; and a discharging head that comprises a plurality of distributor pipes emanating in a star shape from the stack, wherein the discharging head is provided on an upper free end of the stack, and wherein the plurality of distributor pipes each include at a free end an exit opening, and wherein an end region of each of the plurality of distributor pipes is designed as a jet pump in which the explosive gas is a motive medium that takes in ambient air; and wherein the plurality of distributor pipes are arranged in two levels, providing exit openings in a lower level and providing exit openings in an upper level, wherein each jet pump includes a driving nozzle, a diffuser, and a mixing chamber adjacent to the nozzle, where the ambient air is sucked in due to an underpressure set up in the diffuser, wherein the driving nozzle is substantially arranged within the mixing chamber, wherein the intake ambient air is mixed with the explosive gas in the diffuser disposed after the mixing chamber in a flow direction, and wherein the mixture is blown out of the exit opening, and wherein the plurality of distributor pipes of the upper level are inclined upward at a prescribed angle with respect to the roof, and wherein the plurality of distributor pipes of the lower level are arranged horizontally with respect to the roof, wherein the plurality of distributor pipes of the upper level and the plurality of distributor pipes of the lower are arranged in an alternating manner such that an angular offset with respect to the vertical axis of the stack exists between each distributor pipe of the upper level and an adjacent distributor pipe of the lower level.

* * * * *